US006056234A

United States Patent [19]

Kim

[11] Patent Number: 6,056,234

[45] Date of Patent: May 2, 2000

[54] DEVICE FOR ADJUSTING THE POSITION OF FILM ROLLS IN LAMINATOR

[75] Inventor: Yang-Pioung Kim, Seoul, Rep. of Korea

[73] Assignee: GMP Co., Ltd., Seoul, Rep. of Korea

[21] Appl. No.: 09/286,316

[22] Filed: Apr. 5, 1999

[51] Int. Cl.[7] ..... B65H 16/06

[52] U.S. Cl. ..... 242/598; 242/592; 242/599.3; 242/423.1

[58] Field of Search ..... 242/598, 599.3, 242/599.4, 592, 423.1

[56] References Cited

U.S. PATENT DOCUMENTS

| | | | |
|---|---|---|---|
| 1,955,489 | 4/1934 | Duncan et al. | 242/599.3 X |
| 3,738,588 | 6/1973 | Ayers | 242/423.1 |
| 4,363,455 | 12/1982 | Del Bianco et al. | 242/599.3 X |
| 4,378,095 | 3/1983 | Reynolds | 242/599.3 X |
| 5,975,456 | 11/1999 | Bodkin et al. | 242/592 X |

*Primary Examiner*—Donald P. Walsh
*Assistant Examiner*—Minh-Chou Pham
*Attorney, Agent, or Firm*—Harrison & Egbert

[57] ABSTRACT

A device for adjusting the position of two protective film rolls in laminators having two roll shafts individually having a hexagonal cross-section. The right end of each roll shaft is movably received in a cap. A bolt, having a circular head, a woodruff key part and an externally-threaded part, is fitted into a semicircular hole of the cap at the woodruff key part. The bolt also passes through a hole of a right-hand bracket of the laminator prior to engaging with a tension adjusting handle at the externally-threaded part. Both a compression coil spring and a first bushing are commonly fitted over the bolt at a position between the bracket and the handle. A bolt part axially extends from the left end of each roll shaft, while two shaft adjusting handles movably engage with the bolt part. Doubled bushings are fitted over the bolt part at a position between the two shaft adjusting handles.

1 Claim, 3 Drawing Sheets

DEVICE FOR ADJUSTING THE POSITION OF FILM ROLLS IN LAMINATOR

BACKGROUND OF THE INVENTION

1. Field of the Invention

The present invention relates, in general, to a device for adjusting the position of two protective film rolls on the roll shafts in a laminator and, more particularly, to an improvement in such a device to easily adjust the position of the two film rolls by providing two position adjusting handles at one end of each roll shaft, the two handles being designed to be movable on an associated roll shaft by a predetermined distance, thus selectively moving the film roll on the roll shaft and adjusting the position of the film roll on the roll shaft.

2. Description of the Prior Art

As well known to those skilled in the art, laminators are used for covering both sides of an object sheet with two sheets of protective film. In such a laminator, two film rolls are installed at upper and lower portions of the main body, respectively. The above film rolls supply protective film to both sides of each object sheet in the laminator, thus allowing the film to be coated on both sides of each sheet. During the operation of such a laminator, it is necessary to prevent the protective film from crumpling when the film is coated on both sides of each object sheet. In order to eliminate such a crumpling from the film and accomplish a desired flatness of the film, the positions of the two film rolls on the roll shafts have to be precisely controlled so as to be precisely aligned with each other.

In the prior art, the positions of the two film rolls are adjusted using set bolts provided on the cover caps of the film rolls. That is, the upper and lower film rolls, which are to be installed on the roll shafts of a laminator, are individually provided with a cover cap at each end. The cover caps of the film rolls are also individually provided with a set bolt. When it is necessary to adjust the position of the two film rolls, the set bolts of the cover caps are loosened prior to adjusting the position of the film rolls on the roll shafts as desired. After adjusting the position of the film rolls as desired, the set bolts are fully tightened so as to retain the adjusted position. In a brief description, the position of the film rolls is adjusted by operating the set bolts of the cover caps prior to starting the laminator.

However, the adjustment of the position of the film rolls using such set bolts is problematic in that the adjustment is time-consuming since it is necessary to loosen and tighten the set bolts one by one. This reduces work efficiency while adjusting the position of the film rolls. In addition, the preset position of the film rolls may be undesirably changed during an operation of the laminator. In such a case, it is necessary to stop the operation of the laminator prior to reset the position of the film rolls. However, such a reset of the position is very difficult to users.

SUMMARY OF THE INVENTION

Accordingly, the present invention has been made keeping in mind the above problems occurring in the prior art, and an object of the present invention is to provide a device for adjusting the position of two protective film rolls in laminators, the device having two adjusting handles movably engaging with one end of each roll shaft and allowing a user to adjust the position of each film roll on the roll shaft by operating the two handles after installing the film roll on the roll shaft.

In order to accomplish the above object, the present invention provides a device for adjusting a position of two film rolls in a laminator, comprising: two roll shafts respectively used for holding the two film rolls at upper and lower portions of the laminator, each of the roll shafts having a hexagonal cross-section; a circular cap provided with a hexagonal hole for movably receiving a first end of each of the two roll shafts, the circular cap also having a semicircular hole at a base wall with the semicircular hole being aligned with the hexagonal hole; a bolt consisting of a circular head, a woodruff key part at an inside part of a shank, and an externally-threaded part at an outside part of the shank, the bolt being fitted into the semicircular hole of the circular cap at the woodruff key part with the head of the bolt being positioned inside the cap, the bolt also passing through a hole of a first bracket of the laminator prior to engaging with a tension adjusting handle at the externally-threaded part; a compression coil spring and a first bushing commonly fitted over the bolt at a position between the first bracket and the tension adjusting handle, with the coil spring being movably received in the bushing and being stopped by the first bracket and the tension adjusting handle at both ends thereof; a bolt part integrally and axially extending from a second end of each of the two roll shafts to a length; and two shaft adjusting handles movably engaging with the bolt part, with doubled bushings being fitted over the bolt part while being interposed between the two shaft adjusting handles and being movable in a track hole of a second bracket positioned opposite to the first bracket in the laminator.

BRIEF DESCRIPTION OF THE DRAWINGS

The above and other objects, features and other advantages of the present invention will be more clearly understood from the following detailed description taken in conjunction with the accompanying drawings, in which:

FIGS. 3*a* and 3*b* are sectional views, showing the operation of the device of this invention, in which:

FIG. 3*a* shows a roll shaft fully moved to a left position; and

FIG. 3*b* shows the roll shaft fully moved to a right position.

DESCRIPTION OF THE PREFERRED EMBODIMENTS

Figure 1:
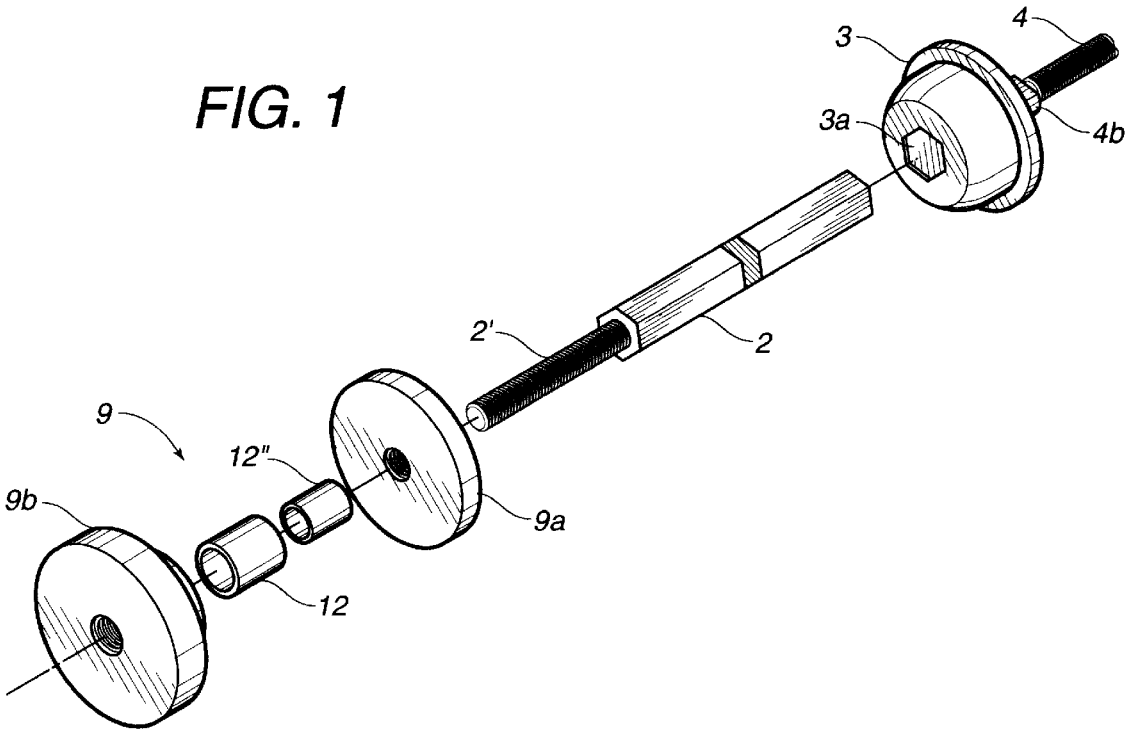
FIG. 1 is an exploded perspective view of a device for adjusting the position of film rolls in a laminator in accordance with the preferred embodiment of the present invention.
Figure 2:
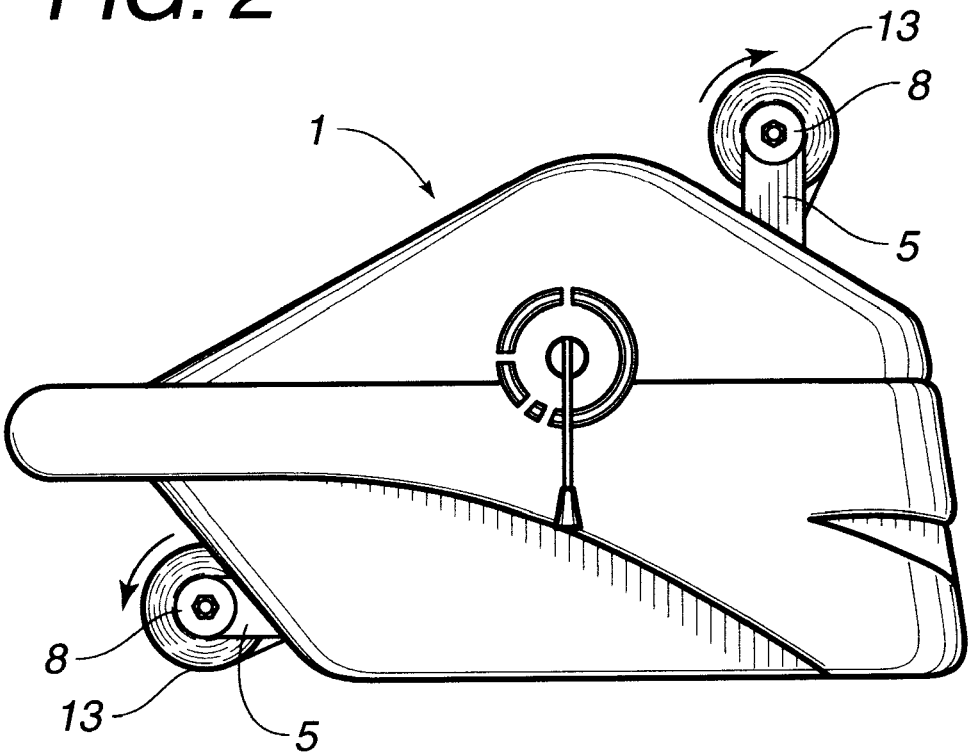
FIG. 2 is a side view, showing the position adjusting device of this invention installed in a laminator.
Figure 3A:
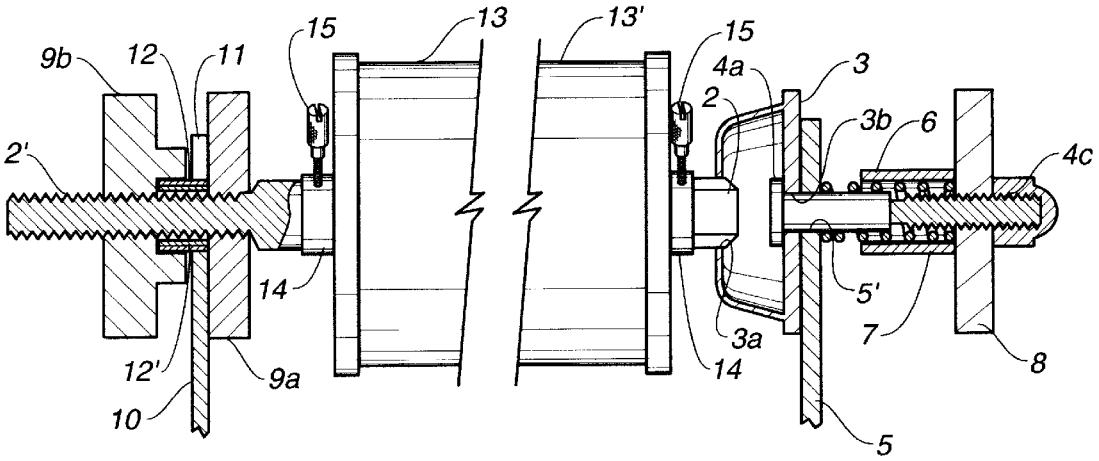
Figure 3B:
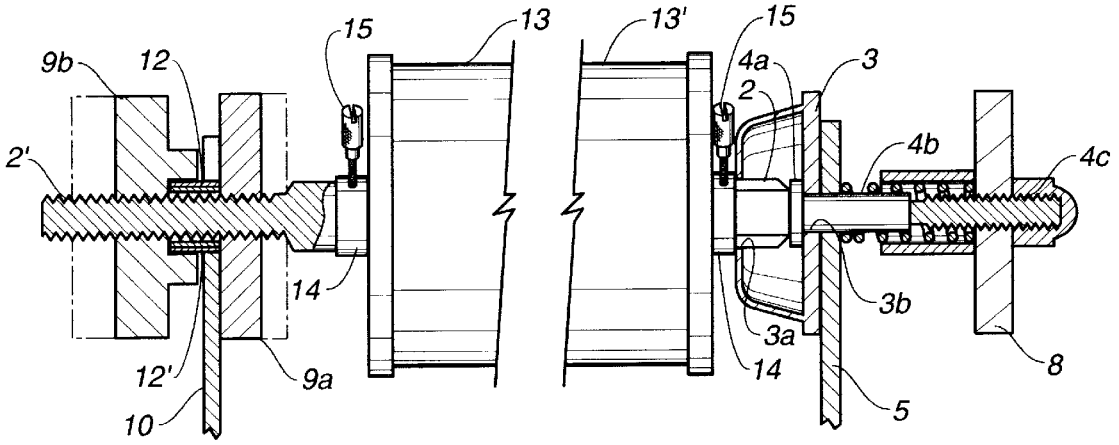

FIG. 1 is an exploded perspective view of a device for adjusting the position of film rolls in a laminator in accordance with the preferred embodiment of this invention. FIG. 2 is a side view, showing the position adjusting device of this invention installed in a laminator. FIGS. 3*a* and 3*b* are sectional views, showing the operation of the above device.

For ease of description, the end of the device on the left-hand side of the drawings will be referred to as the left end of the device and the opposite end on the right-hand side of the drawings will be referred to as the right end.

As shown in the drawings, a roll shaft 2, having a hexagonal cross-section and being used for holding a film roll, is provided in each of the upper and lower portions of a laminator 1. The right end of the above roll shaft 2 is fitted into a hexagonal hole 3*a*, which is formed at the center of a circular cap 3 provided at the right-hand side of the laminator 1. The above circular cap 3 also has a semicircular hole 3*b* at its base wall in a way such that the two holes 3*a* and 3*b* are aligned with each other. A bolt 4, comprising a circular head 4*a*, a woodruff key part 4*b* at the inside part of the shank, and an externally-threaded part 4*c* at the outside part of the shank, is fitted into the semicircular hole 3*b* of the cap 3 at the woodruff key part 4*b* with the head 4*a* being positioned inside the cap 3. The above bolt 4 also passes through a hole 5' of a right-hand bracket 5 of the laminator prior to engaging with a tension adjusting handle 8 at the externally-threaded part 4*c*. In such a case, both a compression coil spring 6 and a bushing 7 are fitted over the bolt 4 at a position between the bracket 5 and the handle 8, with the spring 6 being movably received in the bushing 7 and being stopped by the bracket 5 and the handle 8 at both ends thereof. A bolt part 2' axially extends from the left end of the roll shaft 2 to a length. The above bolt part 2' engages with two shaft adjusting handles 9*a* and 9*b* of a position adjusting unit 9, with doubled bushings 12 and 12' being interposed between the two handles 9*a* and 9*b* and being freely movable in a U-shaped track hole 11 formed on a left-hand bracket 10 of the laminator 1.

In the drawings, the reference numerals 13 and 13' respectively denote upper and lower film rolls, 14 denotes a cover cap used for covering each end of each of the two film rolls 13 and 13', and 15 denotes a set bolt provided on each cover cap 14 so as to stop the cap 14 at a predetermined position on an associated roll shaft 2.

The operational effect of the above device will be described hereinbelow.

The device is assembled as follows.

That is, the bolt 4 is fitted into the semicircular hole 3*b* of the cap 3. Thereafter, the bolt 4 passes through the hole 5' of the right-hand bracket 5 of the laminator 1. Both the compression coil spring 6 and the bushing 7 are fitted over the bolt 4 prior to engaging the externally-threaded part 4*c* of the bolt 4 with the tension adjusting handle 8. A film roll 13, 13' is fitted over the roll shaft 2 prior to fitting the right end of the above roll shaft 2 into the hexagonal hole 3*a* of the cap 3. Thereafter, the first adjusting handle 9*a* is fitted over the bolt part 2' formed at the left end of the roll shaft 2 prior to fitting the doubled bushings 12 and 12' over the bolt part 2' outside the first adjusting handle 9*a*. The doubled bushings 12 and 12' are, thereafter, seated in the U-shaped track hole 11 formed on the left-hand bracket 10 of the laminator 1. The second adjusting handle 9*b* is fitted over the bolt part 2' at a position outside the doubled bushings 12 and 12', thus holding the roll shaft 2 in the laminator 1.

After installing the upper and lower film rolls 13 and 13' on the roll shafts 2 of the laminator 1, the positions of the two film rolls 13 and 13' are adjusted in order to precisely align the two rolls 13 and 13' to each other. In such a case, the positions of the two film rolls 13 and 13' are adjusted by operating the set bolts 15 of the cover caps 14 prior to starting the laminator 1. That is, the cover caps 14 of the two film rolls 13 and 13' are appropriately moved in desired directions on the roll shafts 2 with the set bolts 15 being loosened. After primarily adjusting the positions of the two film rolls 13 and 13' on the roll shafts 2, the set bolts 15 are tightened, thus stopping the adjusted positions of the two rolls 13 and 13' on the roll shafts 2. The laminator 1 is, thereafter, started. When the laminator 1 is started as described above, protective film is supplied from the two rolls to both sides of an object sheet so as to be coated on the sheet.

When a laminated sheet with crumpling film is discharged from the laminator 1, this means that the positions of the two film rolls 13 and 13' are changed from the primarily adjusted position, thus being misaligned. In such a case, the laminator 1 is stopped prior to secondarily adjusting the position of either film roll so as to make the positions of the two film rolls to align with each other. For example, the misaligned position of the two film rolls 13 and 13' may be appropriately readjusted by moving a roll shaft 2 to the right as follows.

That is, the second handle 9*b* is rotated counterclockwise on the bolt part 2' of a selected roll shaft 2 as shown in FIG. 3*b*, so that the handle 9*b* moves on the bolt part 2' to the left until the positions of the two film rolls to be aligned with each other. In such a case, the second handle 9*b* is spaced apart from the first handle 9*a* by an interval.

The first handle 9*a* is, thereafter, rotated counterclockwise on the bolt part 2' of the roll shaft 2, so that the handle 9*a* primarily moves to the left until the handle 9*a* is brought into contact with the bracket 10 of the laminator 1. When the handle 9*a* is further rotated on the bolt part 2' in the same direction after the handle 9*a* comes into contact with the bracket 10, the bolt part 2' starts to move to the right. In such a case, the right end of the roll shaft 2 moves to the right, thus being stopped by the head 4*a* of the bolt 4 inside the cap 3. Such a rightward movement of the roll shaft 2 is stopped when the rotating action of the first handle 9*a* is stopped by the doubled bushings 12 and 12' which are brought into contact with the two handles 9*a* and 9*b* at both ends thereof. The positions of the two film rolls 13 and 13' are thus aligned with each other. The laminator 1 is, thereafter, restarted.

As described above, the present invention provides a device for adjusting the position of two protective film rolls in laminators. When it is necessary to adjust the position of the two film rolls in order to align the positions of the two rolls to each other, the device allows a user to adjust the position of either film roll on an associated roll shaft until the positions of the two film rolls are precisely aligned with each other. The device of this invention thus conserves time while aligning the positions of the two film rolls to each other. In the device of this invention, it is not necessary to operate the set bolts different from the prior art, so that the device of this invention improve work efficiency while adjusting the position of the film rolls in the laminator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. A device for adjusting a position of two film rolls in a laminator, comprising:

two roll shafts respectively used for holding the two film rolls at upper and lower portions of the laminator, each of said roll shafts having a hexagonal cross-section;

a circular cap provided with a hexagonal hole for movably receiving a first end of each of the two roll shafts, said circular cap also having a semicircular hole at a base wall with the semicircular hole being aligned with said hexagonal hole;

a bolt having a circular head, a woodruff key part at an inside part of a shank, and an externally-threaded part at an outside part of the shank, said bolt being fitted into the semicircular hole of the circular cap at said woodruff key part with the head of the bolt being positioned inside the cap, said bolt also passing through a hole of a first bracket of the laminator prior to engaging with a tension adjusting handle at said externally-threaded part;

a compression coil spring and a first bushing commonly fitted over said bolt at a position between the first bracket and the tension adjusting handle, with the coil spring being movably received in the bushing and being stopped by the first bracket and the tension adjusting handle at both ends thereof;

a bolt part integrally and axially extending from a second end of each of the two roll shafts to a length; and two shaft adjusting handles movably engaging with said bolt part, with doubled bushings being fitted over the bolt part while being interposed between the two shaft adjusting handles and being movable in a track hole of a second bracket positioned opposite to said first bracket in the laminator.

* * * * *